US009978298B2

(12) United States Patent
Tsai et al.

(10) Patent No.: US 9,978,298 B2
(45) Date of Patent: May 22, 2018

(54) DISPLAY PANEL AND DRIVING METHOD THEREOF

(71) Applicant: E Ink Holdings Inc., Hsinchu (TW)

(72) Inventors: Wei-Hsuan Tsai, Taoyuan (TW); Shao-Wei Su, Taoyuan (TW); Chih-Jen Wu, Taoyuan (TW); Chi-Mao Hung, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 208 days.

(21) Appl. No.: 14/813,134

(22) Filed: Jul. 30, 2015

(65) Prior Publication Data

US 2016/0180753 A1 Jun. 23, 2016

(30) Foreign Application Priority Data

Dec. 18, 2014 (TW) ..... 103144286 A

(51) Int. Cl.
*G09G 3/04* (2006.01)
*G09G 3/34* (2006.01)

(52) U.S. Cl.
CPC ..... *G09G 3/04* (2013.01); *G09G 3/344* (2013.01); *G09G 2310/04* (2013.01)

(58) Field of Classification Search
None
See application file for complete search history.

(56) References Cited

U.S. PATENT DOCUMENTS 3,781,863 A 12/1973 Fujita
4,091,377 A * 5/1978 Shimoi ..... G02F 1/134327 345/209
4,264,963 A * 4/1981 Leach ..... G09G 3/04 345/213
4,356,483 A 10/1982 Fujita et al.
5,323,143 A * 6/1994 Naradate ..... G09F 9/35 345/50
6,751,898 B2 6/2004 Heropoulos et al.
2002/0122013 A1* 9/2002 Koike ..... G06F 3/147 345/3.2
2007/0057907 A1 3/2007 Ishii et al.
2007/0080928 A1 4/2007 Ishii et al.
(Continued)

FOREIGN PATENT DOCUMENTS

CN 101241670 8/2008
CN 101887694 11/2010
(Continued)

OTHER PUBLICATIONS

"Office Action of China Counterpart Application," dated Feb. 14, 2018, p. 1-p. 8, in which the listed references were cited.

*Primary Examiner* — Kenneth Bukowski
(74) *Attorney, Agent, or Firm* — JCIPRNET

(57) ABSTRACT

A display panel including a plurality of digital code display units is provided. The digital code display units respectively display digital codes. Each of the digital code display units includes a plurality of display segments. The display segments are at least grouped into a first group and a second group. A signal waveform of at least one of a plurality of common voltage signals that drive the first group is the same as a signal waveform of at least one of a plurality of common voltage signals that drive the second group. Furthermore, a driving method of the display panel is also provided.

29 Claims, 5 Drawing Sheets

(56) References Cited

U.S. PATENT DOCUMENTS

| | | | | |
|---|---|---|---|---|
| 2008/0024431 | A1* | 1/2008 | Ishii | G02F 1/167 345/107 |
| 2011/0169814 | A1* | 7/2011 | Van Ess | G09G 3/3611 345/212 |
| 2013/0038805 | A1 | 2/2013 | Katagiri et al. | |
| 2014/0063389 | A1* | 3/2014 | Matsumoto | G09G 3/3644 349/33 |

FOREIGN PATENT DOCUMENTS

| | | | |
|---|---|---|---|
| CN | 102855044 | | 1/2013 |
| JP | 2000-047603 | * | 2/2000 |

* cited by examiner

DISPLAY PANEL AND DRIVING METHOD THEREOF

CROSS-REFERENCE TO RELATED APPLICATION

This application claims the priority benefit of Taiwan application serial no. 103144286, filed on Dec. 18, 2014. The entirety of the above-mentioned patent application is hereby incorporated by reference herein and made a part of this specification.

BACKGROUND OF THE INVENTION

1. Field of the Invention

The invention relates to a panel and a driving method thereof, and particularly relates to a display panel and a driving method thereof.

2. Description of Related Art

Generally speaking, segmented electronic paper displays have the characteristics of having a lower power consumption and weight and being durable. Even under the sunlight, the segmented electronic display is still able to clearly display the contents, and still has a display function when there is no power connection. When applied to display digital codes, a segmented electronic paper display includes a display panel having a plurality of digital code display units. In the conventional art, the driving circuit usually drives the digital code display units of the display panel by using one common electrode signal. This way of driving usually needs to be configured with a display panel with complicated wiring. In addition to the increased complexity of the wiring layout, the driving circuit thereof also needs to be designed with a significant number of output pins to transmit electrical signals to the display panel. The driving circuit with a significant amount of output pins increases the manufacturing cost of the segmented electronic paper display, and it is also difficult for the designer to further expand the driving circuit to allow the driving circuit to offer additional operational functions.

SUMMARY OF THE INVENTION

The invention provides a display panel and a driving method thereof. A panel structure and the driving method of the display panel are capable of reducing the number of signal pins of a driving circuit.

A display panel of the invention includes a plurality of digital code display units. Each of the digital code display units displays a digital code. Each of the digital code display units includes a plurality of display segments. The display segments are at least grouped into a first group and a second group. A signal waveform of at least one of a plurality of common electrode signals for driving the first group is the same as a signal waveform of at least one of a plurality common electrode signals for driving the second group.

According to an embodiment of the invention, the number of the display segments included in the first group is larger than the number of the display segments included in the second group. The number of the common electrode signals for driving the first group is larger than the number of the common electrode signals for driving the second group.

According to an embodiment of the invention, the first group includes a first display segment, a second display segment, and a third display segment of the display segments. The common electrode signals for driving the first group include a first common electrode signal, a second common electrode signal, and a third common electrode signal, and the first, the second, and the third common electrode signals have different signal waveforms for driving the first, the second, and the third display segments respectively.

According to an embodiment of the invention, the first display segment and the third display segment extend in a first direction and are arranged in a second direction.

According to an embodiment of the invention, the second display segment extends in the second direction. The digital code display units are arranged in the first direction.

According to an embodiment of the invention, the second group includes a fourth display segment, and a fifth display segment of the display segments. The common electrode signals for driving the second group are two common electrode signals selected from the first, the second, and the third common electrode signals for driving the fourth and the fifth display segments respectively.

According to an embodiment of the invention, the fourth display segment and the fifth display segment are arranged in a first direction and extend in a second direction. The digital code display units are arranged in the first direction.

According to an embodiment of the invention, a signal waveform of at least one common electrode signal for driving the display segments other than the first group and the second group of the display segments is the same as a signal waveform of one of the common electrode signals for driving the first group.

According to an embodiment of the invention, a signal waveform of at least one common electrode signal for driving the display segments other than the first group and the second group of the display segments s different from signal waveforms of the common electrode signals for driving the first group.

According to an embodiment of the invention, the display segments include a sixth display segment and a seventh display segment other than the first group and the second group. The at least one common electrode signal for driving the display segments other than the first group and the second group of the display segments includes a fourth common electrode signal for driving the sixth and the seventh display segments.

According to an embodiment of the invention, the sixth display segment extends in a first direction. The second display segment extends in a second direction. The digital code display units are arranged in the first direction.

According to an embodiment of the invention, the display segments included in the first group are coupled to a driving circuit through a first signal line. The display segments included in the second group are coupled to the driving circuit through a second signal line.

According to an embodiment of the invention, the driving circuit transmits one of a plurality of first driving signals to the first group by using the first signal line to drive the first group. The driving circuit transmits one of a plurality of second driving signals to the second group by using the second signal line to drive the second group. The first signal line is different from the second signal line.

According to an embodiment of the invention, the display segments other than the first group and the second group of the display segments are respectively coupled to the driving circuit through a plurality of third signal lines. The third signal lines are different from the first and the second signal lines.

According to an embodiment of the invention, the driving circuit transmits a plurality of third driving signals to the display segments other than the first and the second groups of the display segments by respectively using the third signal lines to drive the display segments other than the first and the second groups of the display segments.

According to an embodiment of the invention, a combination of the display segments included in the first group is driven by the common electrode signals to present at least four display states. A combination of the display segments included in the second group is driven by the common electrode signals to present at least three display states.

According to an embodiment of the invention, the combination of the display segments included in the first group is driven by one of a plurality of first driving signals to present one of the four display states. The combination of the display segments included in the second group is driven by one of a plurality of second driving signals to present one of the three display states.

A driving method of a display panel of the invention includes steps as follows: driving a first group of the display segments by using a plurality of common electrode signals; and driving a second group by using at least one of the common electrode signals.

According to an embodiment of the invention, the step of driving the first group of the display segments by using the common electrode signals includes a step as follows: driving the first group of the display segments by using one of a plurality of first driving signals together with the common electrode signals. The step of driving the second group by using the at least one of the common electrode signals includes a step as follows: driving the second group of the display segments by using one of a plurality of second driving signals together with the at least one of the common electrode signals.

According to an embodiment of the invention, the driving method further includes a step as follows: driving at least one display segment other than the first group and second group of the display segments in the at least one digital code display unit by using a common electrode signal other than the common electrode signals for driving the first group and the second group.

According to an embodiment, the step of driving the at least one display segment other than the first group and second group of the display segments in the at least one digital code display unit by using the common electrode signal other than the common electrode signals for driving the first group and the second group includes a step as follows: driving the display segments other than the first group and the second group by using a plurality of third driving signals together with the common electrode signal other than the common electrode signals for driving the first group and the second group.

According to an embodiment of the invention, the first group includes a first display segment, a second display segment, and a third display segment of the display segments. the step of driving the first group of the display segments by using the common electrode signals includes a step as follows: driving the first, second and third display segments by using a first common electrode signal, a second common electrode signal, and a third common electrode signal of the common electrode signals respectively. In addition, the first, the second, and the third common electrode signals have different signal waveforms.

According to an embodiment of the invention, the second group includes a fourth display segment, and a fifth display segment of the display segments. The step of driving the second group by using the at least one of the common electrode signals includes a step as follows: driving the fourth and the fifth display segments by using two common electrode signals chosen from the first, the second, and the third common electrode signals.

According to an embodiment of the invention, the display segments include a sixth display segment and a seventh display segment other than the first group and the second group. The driving method further includes a step as follows: driving the sixth display segment and the seventh display segment by using a fourth common electrode signal other than the common electrode signals.

According to an embodiment of the invention, a signal waveform of the fourth common electrode signal is different from signal waveforms of the first, the second, and the third common electrode signals.

According to an embodiment of the invention, a signal waveform of the fourth common electrode signal is the same as one of signal waveforms of the first, the second, and the third common electrode signals.

Based on the above, in the exemplary embodiments of the invention, the display segments of each digital code display unit are grouped into a plurality of groups, and at least one of the common electrode signals for driving different groups have the same signal waveform. The driving method, together with the structure of the display panel, is able to reduce the number of pins for the driving circuit to transmit electrical signals.

To make the above features and advantages of the invention more comprehensible, embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
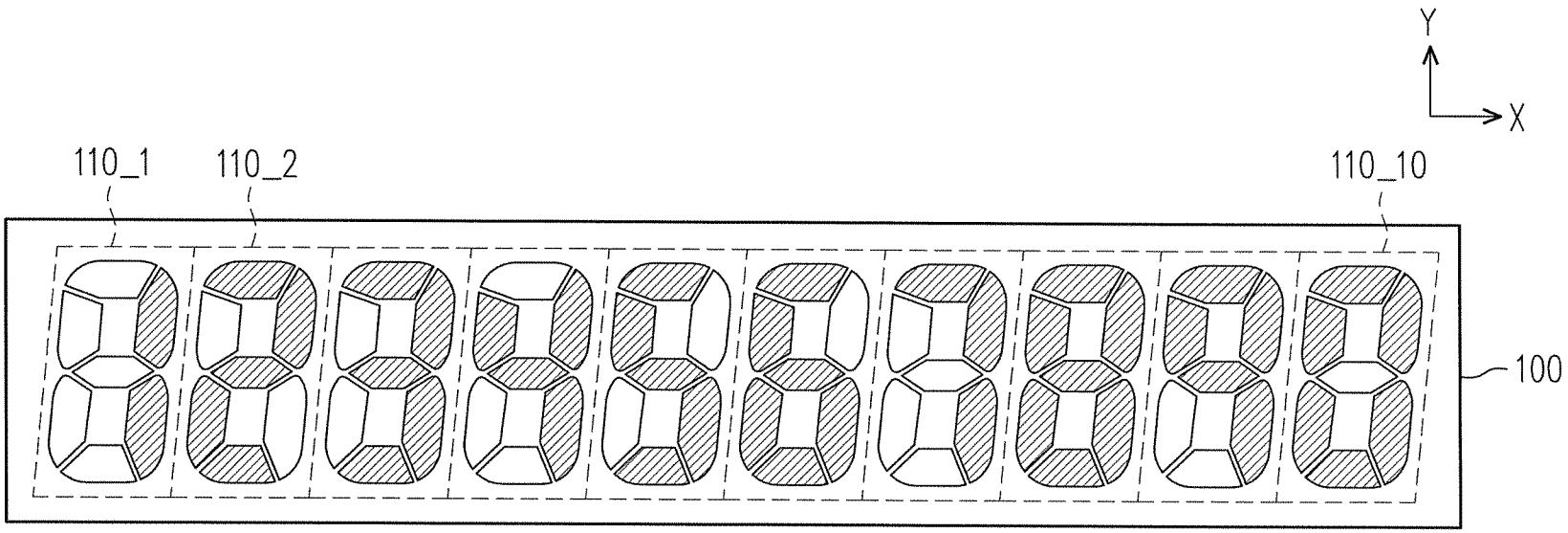
FIG. 1 is a schematic view illustrating a display panel according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

In the following, a plurality of embodiments are provided to describe the invention. However, the invention is not limited to the embodiments exemplified in the following. Also, the embodiments are allowed to be appropriately combined.

Figure 2:
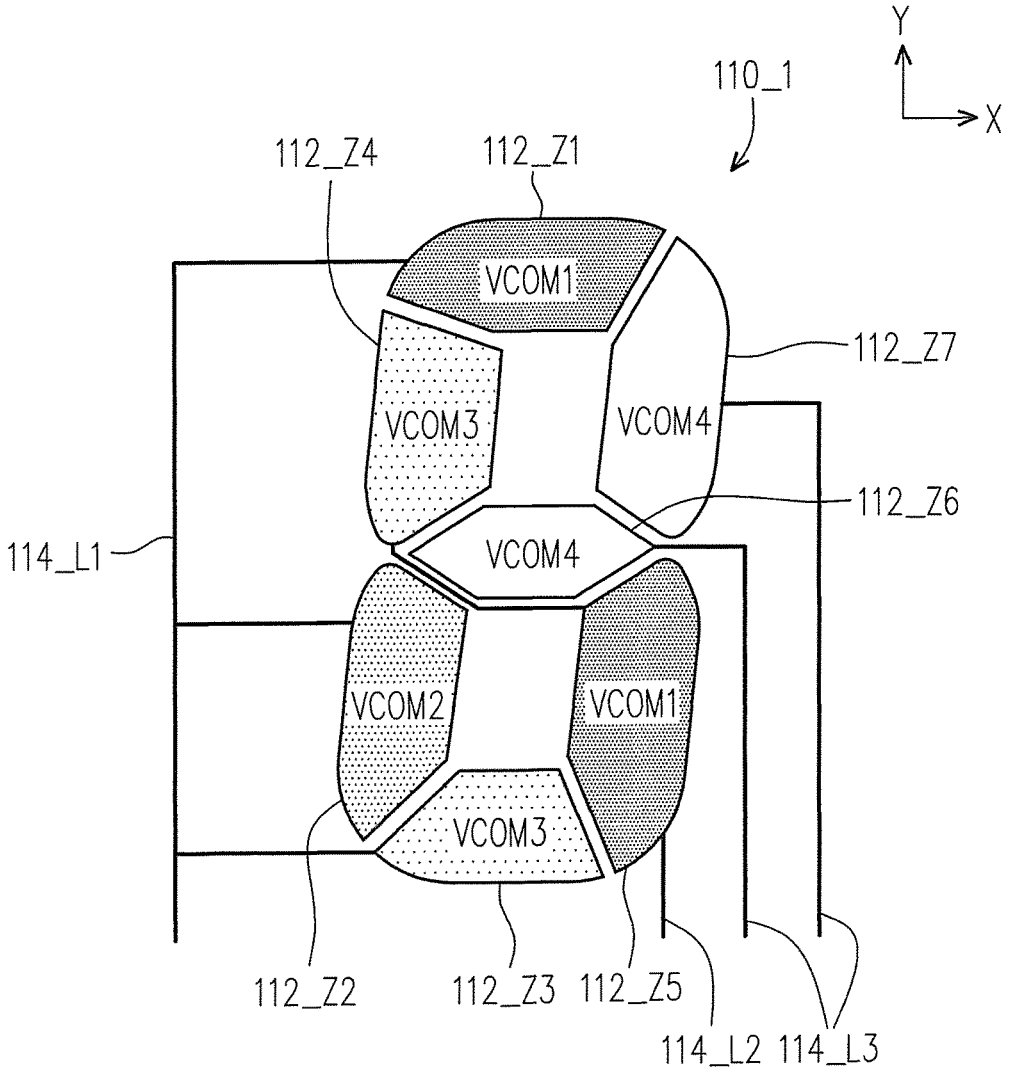
FIG. 2 is a schematic view illustrating an individual digital code display unit shown in FIG. 1.

FIG. 1 is a schematic view illustrating a display panel according to an embodiment of the invention. FIG. 2 is a schematic view illustrating an individual digital code display unit shown in FIG. 1. Referring to FIGS. 1 and 2, a display panel 100 of this embodiment includes a plurality of digital code display units 110_1 to 110_10. The digital code display units 110_1 to 110_10 are arranged in a first direction X, and each of the digital code display units 110_1 to 110_10 displays a digital code. In addition, the digital code at least includes numerals 0 to 9. However, the invention is not limited thereto. In this embodiment, the number of the digital code display units 110_1 to 110_10 that the display panel 100 includes is 10, for example. However, the number is only described herein for an illustrative purpose and does not serve to limit the invention.

In this embodiment, taking the digital code display unit 110_1 as an example, the digital code display unit 110_1 includes a plurality of display segments 112_Z1 to 112_Z7. Based on a plurality of combinations of the display segments 112_Z1 to 112_Z7, the digital code display unit 110_1 at least displays one of the numerals 0 to 9. However, the invention is not limited thereto. Also, in this embodiment, the display segments 112_Z1 to 112_Z7 may be grouped into different groups, and each of the groups includes at least two of the display segments 112_Z1 to 112_Z7.

Specifically, in this embodiment, the display segments 112_Z7 to 112_Z7 of the digital code display unit 110_1 are grouped into a first group and a second group, for example. For example, the first group includes the first display segment 112_Z1, the second display segment 112_Z2, and the third display segment 112_Z3 of the display segments 112_Z1 to 112_Z7, and the three display segments are three display segments coupled to each other in this embodiment. The second group includes the fourth display segment 112_Z4 and the fifth display segment 112_Z5 of the display segments 112_Z1 to 112_Z7. Also, the two display segments are also two display segments coupled to each other in this embodiment. Namely, in this embodiment, the number of the display segments included in the first group is larger than the number of the display segments included in the second group. However, the invention is not limited thereto. In this embodiment, in addition to the first group and the second group, the digital code display unit 110_1 further includes a third group. The third group includes the sixth display segment 112_Z6 and the seventh display segment 112_Z7. The two segments are two segments that are not coupled to each other in this embodiment. In this embodiment, the number of the groups formed of the display segments 112_Z1 to 112_Z7 is two, for example. However, the invention is not limited thereto. In an embodiment, the display segments 112_Z1 to 112_Z7 may also be grouped into three or more groups.

In this embodiment, taking the first group as an example, the first display segment 112_Z1 and the third display segment 112_Z3 extend in the first direction X and are arranged in a second direction Y. The arrangement direction of the first display segment 112_Z1 and the third display segment 112_Z3 is perpendicular to the arrangement direction of the digital code display units 110_1 to 110_10. The second display segment 112_Z2 extends in the second direction Y. In this embodiment, taking the second group as an example, the fourth display segment 112_Z4 and the fifth display segment 112_Z5 are arranged in the first direction X and extend in the second direction Y. The arrangement direction of the fourth display segment 112_Z4 and the fifth display segment 112_Z5 is the same as the arrangement direction of the digital code display units 110_1 to 110_10. Also, in this embodiment, the seventh display segment 112_Z7 extends in the second direction Y, and the sixth display segment 112_Z6 extends in the first direction X. The arrangement directions and extending directions of the display segments of the respective groups described in this embodiment are only provided for an illustrative purpose, and the invention is not limited thereto. In an embodiment, the combinations of display segments of the respective groups may be arbitrarily decided by the display segments included in the digital code display unit. The invention does not intend to limit the combinations.

Besides, as teachings, suggestions, and embodying details about arrangements and structural features of the display segments of the digital code display units 110_2 to 110_10 are already sufficiently provided based on the description of the embodiment shown in FIGS. 1 and 2, details in this respect will not be repeated below.

Figure 3:
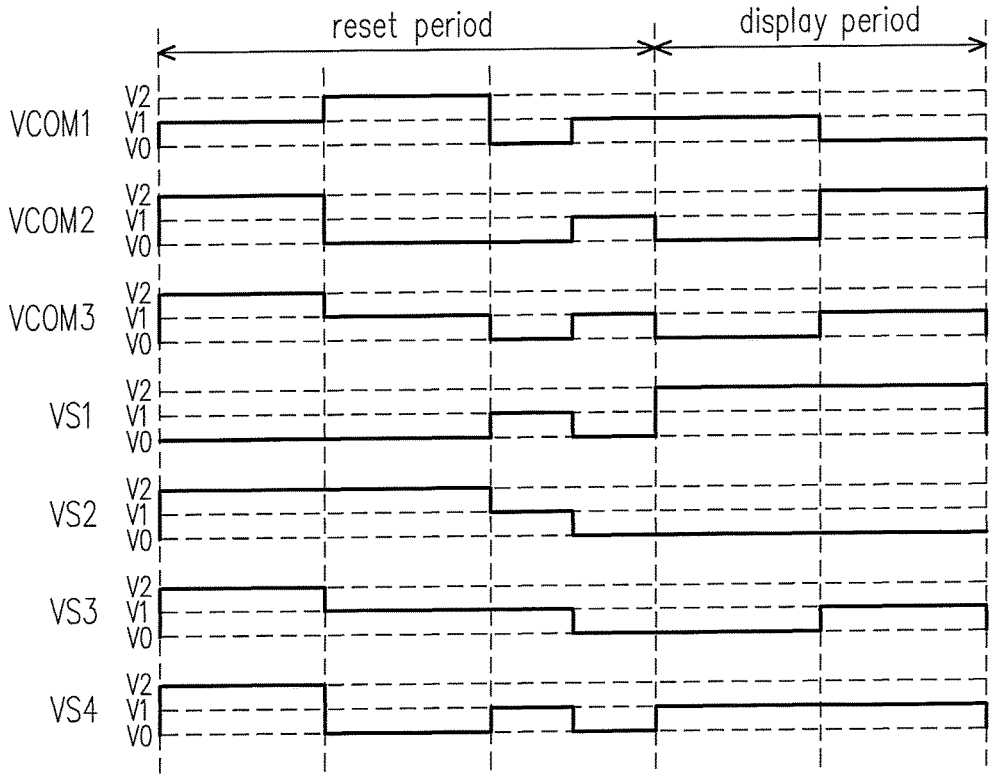
FIG. 3 is a schematic view illustrating waveforms of a plurality of common electrode signals and driving signals that drive a first group according to an embodiment of the invention.
Figure 4:
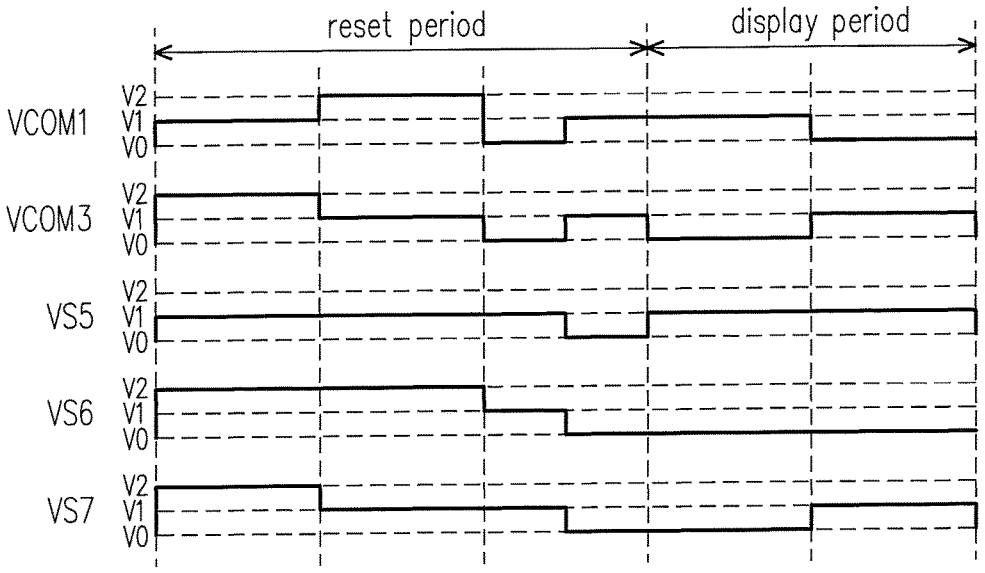
FIG. 4 is a schematic view illustrating waveforms of a plurality of common electrode signals and driving signals that drive a second group according to an embodiment of the invention.

In this embodiment, a signal waveform of at least one of a plurality of common electrode signals for driving the first group is the same as a signal waveform of at least one of a plurality of common electrode signals for driving the second group. Specifically, FIG. 3 is a schematic view illustrating waveforms of the common electrode signals and driving signals that drive the first group according to an embodiment of the invention. FIG. 4 is a schematic view illustrating waveforms of the common electrode signals and driving signals that drive the second group according to an embodiment of the invention. Referring to FIGS. 2 to 4 and taking the digital code display unit 110_1 as an example again, in this embodiment, the common electrode signals for driving the first group include a common electrode signal VCOM1, a common electrode signal VCOM2, and a common electrode signal VCOM3, and the common electrode signals VCOM1, VCOM2, and VCOM3 have different signal waveforms and respectively drive the first display segment 112_Z1, the second display segment 112_Z2, and the third display segment 112_Z3. In this embodiment, during a display period, one of a plurality of first driving signals VS1 to VS4 is operated together with the common electrode signals VCOM1, VCOM2, and VCOM3 to drive the first group, such that the first display segment 112_Z1, the second display segment 112_Z2, and the third display segment 112_Z3 display in white or black.

For example, in this embodiment, an operation of the first driving signal VS1 together with the common electrode signals VCOM1, VCOM2, and VCOM3 during the display period may drive the first display segment 112_Z1, the second display segment 112_Z2, and the third display segment 112_Z3 to all display in black. During the display period, an operation of the first driving signal VS2 together with the common electrode signals VCOM1, VCOM2, and VCOM3 may drive the first display segment 112_Z1, the second display segment 112_Z2, and the third display segment 112_Z3 to all display in white. During the display period, an operation of the first driving signal VS3 together with the common electrode signals VCOM1, VCOM2, and VCOM3 may drive the first display segment 112_Z1, the second display segment 112_Z2, and the third display segment 112_Z3 to display in black, white, and white, respectively. During the display period, an operation of the first driving signal VS4 together with the common electrode signals VCOM1, VCOM2, and VCOM3 may drive the first display segment 112_Z1, the second display segment 112_Z2, and the third display segment 112_Z3 to display in black, white, and black, respectively. Therefore, in this embodiment, for the first group, a driving circuit uses three different common electrode signals VCOM1, VCOM2, and VCOM3 together with one of the first driving signals VS1 to VS4 during the display period to drive the first display segment 112_Z1, the second display segment 112_Z2, and the third display segment 112_Z3, so as to make the display segments of the first group present one of four display states. In this embodiment, the display states refer to a combination of the display segments displaying combinations of different levels of gray-scales or colors (e.g., black or white).

Moreover, in this embodiment, the common electrode signals for driving the second group include the common electrode signals VCOM3 and VCOM1 having different signal waveforms and respectively driving the fourth display segment 112_Z4 and the fifth display segment 112_Z5. Namely, in this embodiment, the common electrode signals for driving the second group are the two common electrode signals VCOM3 and VCOM1 selected from the common electrode signals VCOM1, VCOM2, and VCOM3. In this embodiment, during the display period, one of a plurality of second driving signals VS5 and VS6 is operated together with the common electrode signals VCOM3 and VCOM1 to drive the second group, so as to make the fourth display segment 112_Z4 and the fifth display segment 112_Z5 display in white or black accordingly.

For example, in this embodiment, an operation of the second driving signal VS5 together with the common electrode signal VCOM3 and the common electrode signal VCOM1 during the display period may drive the fourth display segment 112_Z4 and the fifth display segment 112_Z5 to display in black. During the display period, an operation of the second driving signal VS6 together with the common electrode signal VCOM3 and the common electrode signal VCOM1 may drive the fourth display segment 112_Z4 and the fifth display segment 112_Z5 to display in white. During the display period, an operation of the second driving signal VS7 together with the common electrode signal VCOM3 and the common electrode signal VCOM1 may drive the fourth display segment 112_Z4 and the fifth display segment 112_Z5 to display in white and black respectively. Therefore, in this embodiment, for the second group, the driving circuit uses two different common electrode signals together with one of the second driving signals VS5 to VS7 to drive the fourth display segment 112_Z4 and the fifth display segment 112_Z5, so as to make the display segments of the second group present one of three display states. In this embodiment, the display states refer to a combination of the display segments displaying combinations of different levels of gray-scales or colors (e.g., black or white).

In this embodiment, the signal waveform of the common electrode signal VCOM3 for driving the second group is the same as the waveform of one of the common electrode signals VCOM1, VCOM2, and VCOM3 for driving the first group. In this example, the signal waveform of the common electrode signal VCOM3 for driving the second group and the signal waveform of the common electrode signal VCOM3 for driving the first group are the same, and are thus referred to by the same symbol The signal waveform of the common electrode signal VCOM1 for driving the second group and the signal waveform of another of the common electrode signals VCOM1, VCOM2, and VCOM3 for driving the first group are the same. In this example, the signal waveform of the common electrode signal VCOM1 for driving the second group and the signal waveform of the common electrode signal VCOM1 for driving the first group are the same, and are thus referred to by the same symbol Thus, in this embodiment, while the number of the common electrode signals for driving the first group is larger than the number of the common electrode signal for driving the second group, the invention is not limited by the numbers.

Figure 5:
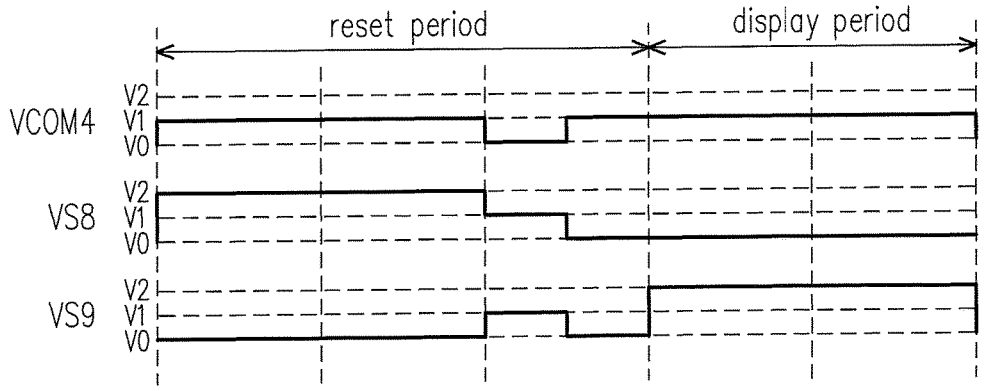
FIG. 5 is a schematic view illustrating waveforms of a common electrode signal and driving signals for driving display segments other than the first group and the second group according to an embodiment of the invention.

In this embodiment, taking the third group as an example, a common electrode signal for driving the display segments 112_Z6 and 112_Z7 other than the first group and the second group has a signal waveform different from the signal waveforms of the common electrode signals VCOM1 to VCOM3 for driving the first group. Specifically, FIG. 5 is a schematic view illustrating waveforms of the common electrode signal and driving signals for driving the display segments other than the first group and the second group according to an embodiment of the invention. In this embodiment, the common electrode signal for driving the display segments 112_Z6 and 112_Z7 other than the first and the second groups is a common electrode signal VCOM4, for example. The common electrode signal VCOM4 drives the sixth display segment 112_Z6 and the seventh display segment 112_Z7. In this embodiment, a signal waveform of the common electrode signal VCOM4 is different from the signal waveforms of the common electrode signals VCOM1, VCOM2, and VCOM3 for driving the first group. In this embodiment, during the display period, one of a plurality of third driving signals VS8 and VS9 is operated together with the common electrode signal VCOM4 to drive the sixth display segment 112_Z6 and the seventh display segment 112_Z7, so as to make the sixth display segment 112_Z6 and the seventh display segment 112_Z7 display in white or black accordingly.

For example, in this embodiment, an operation of the third driving signal VS8 together with the common electrode signal VCOM4 during the display period may drive the sixth display segment 112_Z6 and the seventh display segment 112_Z7 to display in white. During the display period, an operation of the third driving signal VS9 together with the common electrode signal VCOM4 may drive the sixth display segment 112_Z6 and the seventh display segment 112_Z7 to display in black.

Referring to FIG. 2 again, in this embodiment, the first display segment 112_Z1, the second display segment 112_Z2, and the third display segment 112_Z3 included in the first group are coupled to the driving circuit (not shown) through a first signal line 114_L1. The fourth display segment 112_Z4 and the fifth display segment 112_Z5 are coupled to the driving circuit through a second signal line 114_L2. The sixth display segment 112_Z8 and the seventh display segment 112_Z7 are respectively coupled to the driving circuit through a plurality of third signal lines 114_L3. In this embodiment, the first signal line 114_L1 and the second signal line 114_L2 are different signal lines. The third signal lines 114_L3 are signal lines different from the first signal line 114_L1 and the second signal line 114_L2.

In this embodiment, the first signal line 114_L1, the second signal line 114_L2, and the third signal lines 114_L3 are a metal electrode layer, such as a copper foil electrode layer, arranged in the display panel 100. In this embodiment, the driving circuit transmits the driving signals (e.g., the driving signals VS1 to VS4 shown in FIG. 3) to the display segments 112_Z1 to 112_Z3 of the first group by using the first signal line 114_L1, for example. The driving circuit transmits the driving signals (e.g., the driving signals VS5 to VS7 shown in FIG. 4) to the display segments 112_Z4 and 112_Z5 of the second group by using the second signal line 114_L2, for example. The driving circuit transmits the driving signals (e.g., the driving signals VS8 and VS9 shown in FIG. 5) to the sixth display segment 112_Z6 and the seventh display segment 112_Z7 by using the different third signal lines 114_L3, for example. Therefore, in this embodiment, the number of signal lines for transmitting the driving signals for the digital code unit 110_1 is 4. In an exemplary embodiment of a seven-segment display, the number of signal lines for the display segments to be coupled to the driving circuit may be reduced. Namely, in this embodiment, the display segments in the same group are coupled to an output pin of the driving circuit by using the same signal line, so as to reduce the number of the signal lines for display segments to be coupled to the driving circuit, thereby reducing the number of signal pins of the driving circuit.

Also, in this embodiment, for the digital code display unit 110_1, the number of the common electrode signals for driving the display segments 112_Z1 to 112_Z7 is substantially 4. However, the invention does not intend to limit the number. Thus, in this embodiment, the number of signal pins of the driving circuit for transmitting the common electrode signals is 4. In the exemplary embodiment of the seven-segment display, the number of the signal pins of the driving circuit may be reduced. The driving circuit uses a transparent electrode layer arranged in the display panel 100, for example, to transmit the electrode signals VCOM1 to VCOM4 to the corresponding display segments. In this embodiment, the transparent electrode layer is an indium tin oxide electrode layer disposed on the metal electrode layer, for example.

In this embodiment, if the digital code display unit 110_1 is to display the number 9, during the display period, the driving circuit may choose to operate the first driving signal VS3, the second driving signal VS5, and the third driving signal VS9 together with the common electrode signals VCOM1 to VCOM4, so as to drive the display segments 112_Z1 to 112_Z7 to display the number 9. The second display segment 112_Z2 and the third display segment 112_Z3 display in white, and the rest display segments 112_Z1 and 112_Z4 to 112_Z7 display in black. Accordingly, operations for the digital code display unit 110_1 to display the numbers 0 to 8 in this embodiment can be known through interference from the above. Thus, details in this respect will not be repeated below.

The signal waveforms and combinations of the common electrode signals and driving signals for driving the respective display segments in the digital code display unit 110_1 in this embodiment are only provided for an illustrative purpose, and the invention is not limited thereto. Based on the practical needs, the signal waveforms, voltage levels V0, V1, and V2, and the signal combinations of the common electrode signals and driving signals for driving the respective display segments may be arbitrarily adjusted, and the invention is not limited thereto.

Besides, as teachings, suggestions, and embodying details about ways of driving operating the respective display segments of the digital code display units 110_2 to 110_10 are sufficiently provided based on the description of the embodiment shown in FIGS. 1 and 5, details in this respect will not be repeated below.

Figure 6:
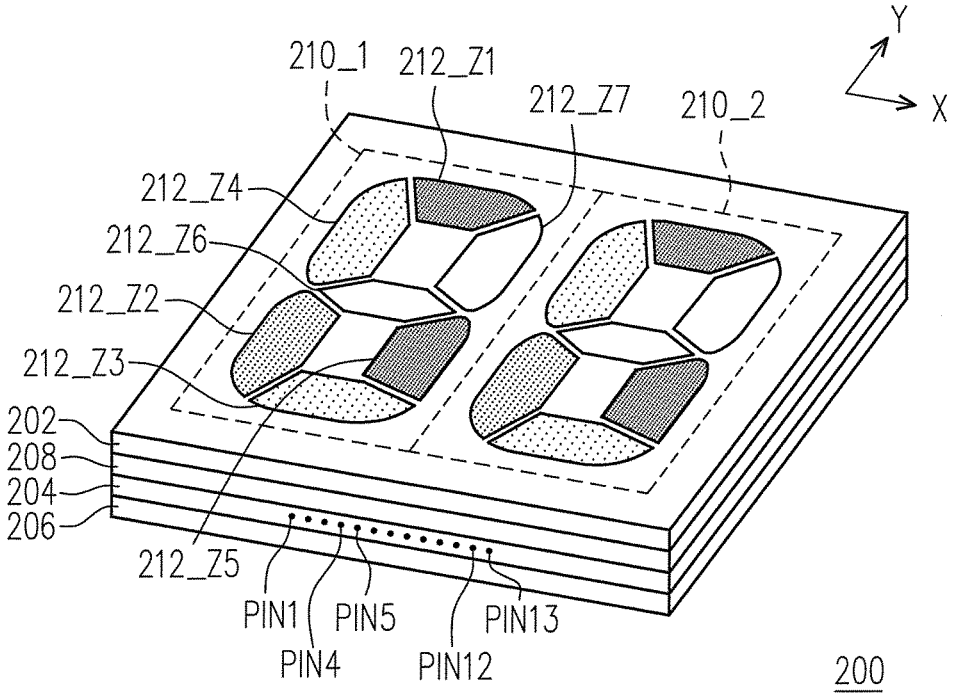
FIG. 6 is a schematic side view illustrating a display panel according to another embodiment of the invention.

FIG. 6 is a schematic side view illustrating a display panel according to another embodiment of the invention. Referring to FIGS. 1 and 6, a display panel 200 of this embodiment is similar to the display panel shown in FIG. 1, but the display panel 200 mainly differs from the display panel 100 in that the display panel 200 includes two digital code display unit 210_1 and 210_2, for example.

In this embodiment, viewing from the side view of the display panel 200, the display 200 is a multi-layered structure, for example, and includes a transparent electrode layer 202, a display layer 208, a metal electrode layer 204, and a substrate 206 that are stacked from top to bottom. In this embodiment, the display layer 208 is an electrophoretic particle layer or a liquid crystal layer controlled by an electrical signal to display image information. In this embodiment, the common electrode signals VCOM1 to VCOM3 for driving the first groups of the digital code display units 210_1 and 210_2 and the common electrode signals VCOM1 to VCOM3 for driving the second groups of the digital code display units 210_1 and 210_2 are provided to corresponding display segments 212_Z1 to 212_Z5 by using signal wiring arranged in the transparent electrode layer 202. Therefore, in the embodiment shown in FIG. 5, electrodes for transmitting the common electrode signal VCOM1 to the first display segment 112_Z1 and the fifth display segment 112_Z5 may be the same or connected common electrodes, and electrodes for transmitting the common electrode signal VCOM3 to the third display segment 112_Z3 and the fourth display segment 112_Z4 may be the same or connected common electrodes. In this embodiment, the common electrode signal VCOM4 for driving the display segments 212_Z6 and 212_Z7 of the digital code display units 210_1 and 210_2 is provided to the corresponding display segments 212_Z6 and 212_Z7 by using signal wiring arranged in the metal electrode layer 204, for example. Thus, the driving signal may use four signal pins PIN1 to PIN4 to transmit the common electrode signals VCOM1 to VCOM4 to the corresponding display segments 212_Z1 to 212_Z7 in the digital code display units 210_1 to 210_2.

In the embodiment shown in FIG. 5, the signal waveform of the common electrode signal VCOM4 for driving the sixth display segment 112_Z6 and the seventh display segment 112_Z7 is different from the signal waveforms of the common electrode signals VCOM1, VCOM2, and VCOM3 for driving the first group. However, the invention is not limited thereto. In an embodiment, the signal waveform of the common electrode signal VCOM4 may be the same as the signal waveform of one of the common electrode signals VCOM1, VCOM2, and VCOM3. For example, if common electrode signals VCOM4 and VCOM1 are the same, the electrodes for transmitting the common electrode signal VCOM1 to the first display segment 112_Z1 and the fifth display segment 112_Z5 and the electrodes for transmitting the common electrode signal VCOM4 to the sixth display segment 112_Z6 and 112_Z7 may be the same or connected common electrodes. If the common electrode signals VCOM4 and VCOM2 are the same, the electrode for transmitting the common electrode signal VCOM2 to the second display segment 112_Z2 and the electrodes for transmitting the common electrode signal VCOM4 to the sixth display segment 112_Z6 and the seventh display segment 112_Z7 may be the same or connected common electrodes. If common electrode signals VCOM4 and VCOM3 are the same, the electrodes for transmitting the common electrode signal VCOM3 to the third display segment 112_Z3 and the fourth display segment 112_Z4 and the electrodes for transmitting the common electrode signal VCOM4 to the sixth display segment 112_Z6 and 112_Z7 may be the same or connected common electrodes.

Also, in this embodiment, taking the digital code display unit 210_1 as an example, the driving signal uses four signal lines, for example, to respectively transmit the driving signals VS1 to VS9 to the display segments of the digital code display unit 210_1, and an operation thereof is similar to the embodiment shown in FIG. 2. Thus, in this embodiment, the display panel 200 includes two digital code display units 210_1 and 210_2, and the driving circuit uses eight signal pins PIN5 to PIN12, for example, to transmit the driving signals VS1 to VS9 to the corresponding display segments 212_Z1 to 212_Z7 in the digital code display units 210_1 and 210_2. Moreover, in this embodiment, the driving circuit further uses a signal pin PIN13 to transmit a driving signal for driving the display panel 200 to display background information to the display panel 200. Thus, in the exemplary embodiment of the seven-segment display, a way of driving according to the embodiment may reduce the number of signal lines for the display segments to be coupled to the driving circuit, so as to reduce the number of pins for the driving circuit to transmit signals.

Also, since the description about the embodiment shown in FIG. 6 provides sufficient teachings, suggestions, and embodying description about the number of signal pins for the driving circuit to drive the display panel 100 in the embodiment shown in FIG. 1, details in this respect will not be repeated below. Thus, in the exemplary embodiment of the seven-segment display, a way of driving according to the embodiment shown in FIG. 1 may reduce the number of signal lines for the display segments to be coupled to the driving circuit, so as to reduce the number of pins for the driving circuit to transmit signals.

Figure 7:
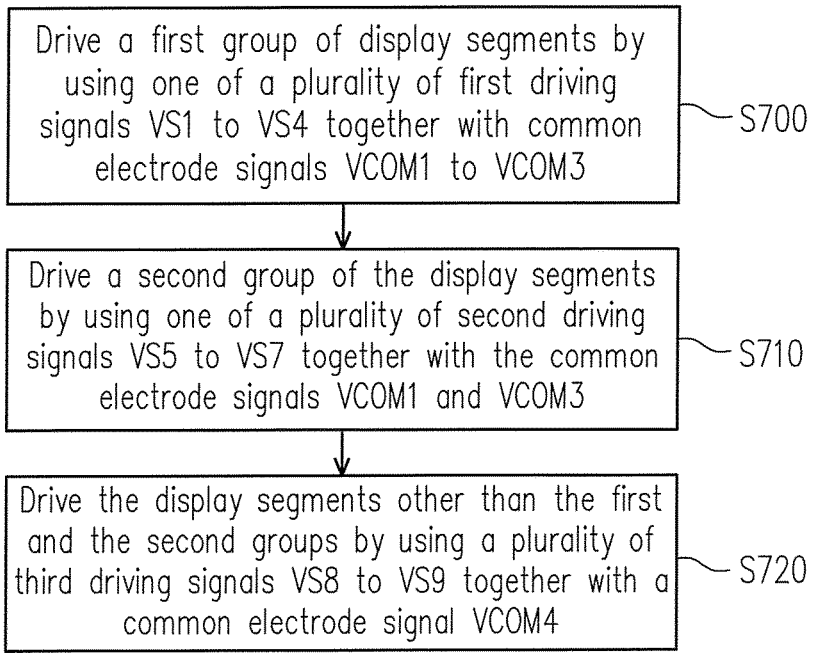
FIG. 7 is a flowchart illustrating a driving method of a display panel according to an embodiment of the invention.

FIG. 7 is a flowchart illustrating a driving method of a display panel according to an embodiment of the invention. Referring to FIGS. 1 and 7, the driving method in this embodiment may be applied to the display panel 100 shown in FIG. 1, for example. Taking driving of the digital code display unit 110_1 as an example, at Step S700, one of the first driving signals VS1 to VS4, together with the common electrode signals VCOM1 to VCOM3, is used to drive the first group of the display segments 112_Z1 to 112_Z7. At Step S710, at least one of the second driving signals VS5 to VS7, together with at least one of the common electrode signals, such as the common electrode signals VCOM1 and VCOM3, is used to drive the second group of the display segments 112_Z1 to 112_Z7. At Step S720, the third driving signals VS8 and VS9, together with the common electrode signal VCOM4, are used to drive the display segments 112_Z6 and 112_Z7 other than the first group and the second group. It should be noted that the steps S700 to S720 are not ordered when the driving method is performed, the steps may be executed at the same time or at different time.

In addition, as teachings, suggestions, and embodying description for the driving method of the display panel shown in FIG. 7 are sufficiently provided by the embodiments shown in FIGS. 1 to 6, details in this respect will not be repeated below.

Also, the digital code display unit according to the embodiments of the invention is described to include seven display segments for an illustrative purpose. However, the invention is not limited thereto. The concept of embodiment of the way of driving the display panel according to the embodiments of the invention is generalizable to a configuration of a digital code display unit including 14 display segments, and teachings, suggestions and details for embodying such configuration are sufficiently provided in the embodiments shown in FIGS. 1 to 7. Thus, details in this respect will not be repeated below.

In view of the foregoing, in the exemplary embodiments of the invention, the display segments of each digital code display unit are grouped into a plurality of groups, and at least one of the common electrode signals for driving different groups have the same signal waveform. In the exemplary embodiments of the invention, when driven by the driving signals and the common electrode signals, the groups of the display segments are capable of displaying in different display states. The driving method, together with the structure of the display panel, is able to reduce the number of pins for the driving circuit to transmit electrical signals.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a plurality of digital code display units, wherein each of the digital code display units displays a digital code and comprises:

a plurality of display segments, at least grouped into a first group and a second group, wherein a signal waveform of at least one of a plurality of common electrode signals for driving the first group is the same as a signal waveform of at least one of a plurality common electrode signals for driving the second group, wherein a plurality of driving signals is configured to drive the first group, and the driving signals are different, wherein one of the driving signals driving the first group drives all of the display segments in the first group to present a first color or gray-scale, and another one of the driving signals driving the first group drives all of the display segments in the first group to present a second color or gray-scale, wherein the first color or gray-scale is different from the second color or gray-scale.

2. The display panel as claimed in claim 1, wherein the number of the display segments comprised in the first group is larger than the number of the display segments comprised in the second group, and the number of the common electrode signals for driving the first group is larger than the number of the common electrode signals for driving the second group.

3. The display panel as claimed in claim 2, wherein the first group comprises a first display segment, a second display segment, and a third display segment of the display segments, and the common electrode signals for driving the first group comprise a first common electrode signal, a second common electrode signal, and a third common electrode signal, wherein the first, the second, and the third common electrode signals have different signal waveforms for driving the first, the second, and the third display segments respectively.

4. The display panel as claimed in claim 3, wherein the first display segment and the third display segment extend in a first direction and are arranged in a second direction, and the digital code display units are arranged in the first direction, wherein the first direction serves as a reference direction, and the first direction is crossed to the second direction.

5. The display panel as claimed in claim 4, wherein the second display segment extends in the second direction.

6. The display panel as claimed in claim 3, wherein the second group comprises a fourth display segment and a fifth display segment of the display segments, and the common electrode signals for driving the second group are two common electrode signals selected from the first, the second, and the third common electrode signals for driving the fourth and the fifth display segments respectively.

7. The display panel as claimed in claim 6, wherein the fourth display segment and the fifth display segment are arranged in a first direction and extend in a second direction, and the digital code display units are arranged in the first direction, and the digital code display unit is arranged in the first direction, wherein the first direction serves as a reference direction, and the first direction is crossed to the second direction.

8. The display panel as claimed in claim 1, wherein the display segments comprise at least one display segment different from the first group and the second group of the display segments, wherein at least one common electrode signal is configured to drive the at least one display segment different from the first group and the second group of the display segments, and a signal waveform of the at least one common electrode signal is the same as a signal waveform of one of the common electrode signals for driving the first group.

9. The display panel as claimed in claim 1, wherein the display segments comprise at least one display segment different from the first group and the second group of the display segments, wherein at least one common electrode signal is configured to drive the at least one display segment different from the first group and the second group of the display segments, and a signal waveform of the at least one common electrode signal is different from signal waveforms of the common electrode signals for driving the first group.

10. The display panel as claimed in claim 9, wherein the display segments comprise a sixth display segment and a seventh display segment other than the first group and the second group, and the at least one common electrode signal for driving the display segments other than the first group and the second group of the display segments comprises a fourth common electrode signal for driving the sixth and the seventh display segments.

11. The display panel as claimed in claim 10, wherein the sixth display segment extends in a first direction, and the seventh display segment extends in a second direction, wherein the first direction is crossed to the second direction.

12. The display panel as claimed in claim 1, wherein the display segments comprised in the first group are coupled to a driving circuit through a first signal line, and the display segments comprised in the second group are coupled to the driving circuit through a second signal line.

13. The display panel as claimed in claim 12, wherein the driving circuit transmits one of a plurality of first driving signals to the first group by using the first signal line to drive the first group, and the driving circuit transmits one of a plurality of second driving signals to the second group by using the second signal line to drive the second group, and the first signal line is different from the second signal line.

14. The display panel as claimed in claim 12, wherein the display segments other than the first group and the second group of the display segments are respectively coupled to the driving circuit through a plurality of third signal lines, and the third signal lines are different from the first and the second signal lines.

15. The display panel as claimed in claim 14, wherein the driving circuit transmits a plurality of third driving signals to the display segments other than the first and the second groups of the display segments by respectively using the third signal lines to drive the display segments other than the first and the second groups of the display segments.

16. The display panel as claimed in claim 1, wherein a combination of the display segments comprised in the first group is driven by the common electrode signals to present at least four display states, and a combination of the display segments comprised in the second group is driven by the common electrode signals to present at least three display states.

17. The display panel as claimed in claim 16, wherein the combination of the display segments comprised in the first group is driven by one of a plurality of first driving signals to present one of the four display states, and the combination of the display segments comprised in the second group is driven by one of a plurality of second driving signals to present one of the three display states.

18. A driving method of a display panel, wherein the display panel comprises at least one digital code display unit for displaying a digital code, and the at least one digital code display unit comprises a plurality of display segments, the driving method comprising:

driving a first group of the display segments by using a plurality of common electrode signals, wherein a plurality of driving signals is configured to drive the first group, and the driving signals are different; and driving a second group of the display segments by using at least one of the common electrode signals, wherein one of the driving signals driving the first group drives all of the display segments in the first group to present a first color or gray-scale, and another one of the driving signals driving the first group drives all of the display segments in the first group to present a second color or gray-scale, wherein the first color or gray-scale is different from the second color.

19. The driving method as claimed in claim 18, wherein the step of driving the first group of the display segments by using the common electrode signals comprises:

driving the first group of the display segments by using one of a plurality of first driving signals together with the common electrode signals; and the step of driving the second group of the display segments by using the at least one of the common electrode signals comprises:

driving the second group of the display segments by using one of a plurality of second driving signals together with the at least one of the common electrode signals.

20. The driving method as claimed in claim 18, further comprising:

driving at least one display segment other than the first group and second group of the display segments in the at least one digital code display unit by using a common electrode signal other than the common electrode signals for driving the first group and second group of the display segments.

21. The driving method as claimed in claim 20, wherein the step of driving the at least one display segment other than the first group and second group of the display segments in the digital code display unit by using the common electrode signal other than the common electrode signals comprises:

driving the display segments other than the first group and the second group by using a plurality of third driving signals together with the common electrode signal other than the common electrode signals for driving the first group and second group of the display segments.

22. The driving method as claimed in claim 18, wherein the first group comprises a first display segment, a second display segment, and a third display segment of the display segments, and the step of driving the first group of the display segments by using the common electrode signals comprises:

driving the first, the second and the third display segments by using a first common electrode signal, a second common electrode signal, and a third common electrode signal of the common electrode signals respectively, wherein the first, the second, and the third common electrode signals have different signal waveforms.

23. The driving method as claimed in claim 22, wherein the second group comprises a fourth display segment, and a fifth display segment of the display segments, and step of driving the second group by using the at least one of the common electrode signals comprises:

driving the fourth and the fifth display segments by using two common electrode signals chosen from the first, the second, and the third common electrode signals.

24. The driving method as claimed in claim 23, wherein the display segments comprise a sixth display segment and a seventh display segment other than the first group and the second group, and the driving method further comprises:

driving the sixth display segment and the seventh display segment by using a fourth common electrode signal other than the common electrode signals for driving the first group and second group of the display segments.

25. The driving method as claimed in claim 24, wherein a signal waveform of the fourth common electrode signal is different from signal waveforms of the first, the second, and the third common electrode signals.

26. The driving method as claimed in claim 24, wherein a signal waveform of the fourth common electrode signal is the same as one of signal waveforms of the first, the second, and the third common electrode signals.

27. The driving method as claimed in claim 18, wherein a combination of the display segments comprised in the first group is driven by the common electrode signals to present at least four display states, and a combination of the display segments comprised in the second group is driven by the common electrode signals to present at least three display states.

28. The driving method as claimed in claim 27, wherein the combination of the display segments comprised in the first group is driven by one of a plurality of first driving signals to present one of the four display states, and the combination of the display segments comprised in the second group is driven by one of a plurality of second driving signals to present one of the three display states.

29. The driving method as claimed in claim 18, wherein the number of the display segments comprised in the first group is larger than the number of the display segments comprised in the second group, and the number of the common electrode signals for driving the first group is larger than the number of the common electrode signals for driving the second group.

* * * * *